US009943722B2

(12) United States Patent
Dalebout

(10) Patent No.: US 9,943,722 B2
(45) Date of Patent: Apr. 17, 2018

(54) DETERMINING WORK PERFORMED ON A TREADMILL

(71) Applicant: ICON Health & Fitness, Inc., Logan, UT (US)

(72) Inventor: William T. Dalebout, North Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 9 days.

(21) Appl. No.: 14/805,151

(22) Filed: Jul. 21, 2015

(65) Prior Publication Data

US 2016/0023045 A1 Jan. 28, 2016

Related U.S. Application Data

(60) Provisional application No. 62/029,371, filed on Jul. 25, 2014.

(51) Int. Cl.
*A63B 24/00* (2006.01)
*A63B 69/16* (2006.01)
(Continued)

(52) U.S. Cl.
CPC ..... *A63B 24/0062* (2013.01); *A63B 22/025* (2015.10); *A63B 24/0087* (2013.01);
(Continued)

(58) Field of Classification Search
CPC . A63B 24/00; A63B 24/0062; A63B 24/0087; A63B 22/02; A63B 22/025; A63B 22/0023; A63B 2230/00; A63B 2230/605; A63B 2230/425; A63B 2230/755; A63B 2230/062; A63B 2230/75; A63B 2230/015; A63B 2220/10; A63B 2220/52;
(Continued)

(56) References Cited

U.S. PATENT DOCUMENTS 4,925,183 A 5/1990 Kim
5,743,835 A 4/1998 Trotter
(Continued)

FOREIGN PATENT DOCUMENTS

CN 103028228 4/2013
TW 200915213 4/2009
(Continued)

OTHER PUBLICATIONS

English Translation of Taiwan First Office Action and Search Report issued for 104131458 dated May 20, 2016.
(Continued)

*Primary Examiner* — Glenn Richman
(74) *Attorney, Agent, or Firm* — Holland & Hart LLP

(57) ABSTRACT

A treadmill system includes a deck, an endless tread belt covering at least a portion of the deck, and a motion transducer positioned to detect movement of the tread belt. The treadmill system also includes a processor and memory where the memory includes instructions executable by the processor to receive an output of the motion transducer, determine an exercise type performed on the tread belt, and calculate an amount of work performed by a user on the tread belt based on the output of the motion transducer and the determined type of exercise.

13 Claims, 11 Drawing Sheets

(51) Int. Cl.

| | |
|---|---|
| *A63B 22/02* | (2006.01) |
| *A63B 71/06* | (2006.01) |
| *A63B 21/22* | (2006.01) |
| *A63B 22/00* | (2006.01) |
| *A63B 71/00* | (2006.01) |

(52) U.S. Cl.

CPC ..... *A63B 69/16* (2013.01); *A63B 21/225* (2013.01); *A63B 22/0023* (2013.01); *A63B 22/02* (2013.01); *A63B 2022/0278* (2013.01); *A63B 2024/0068* (2013.01); *A63B 2024/0071* (2013.01); *A63B 2024/0093* (2013.01); *A63B 2069/165* (2013.01); *A63B 2069/167* (2013.01); *A63B 2069/168* (2013.01); *A63B 2071/0081* (2013.01); *A63B 2071/065* (2013.01); *A63B 2071/0625* (2013.01); *A63B 2071/0638* (2013.01); *A63B 2071/0647* (2013.01); *A63B 2209/10* (2013.01); *A63B 2220/10* (2013.01); *A63B 2220/52* (2013.01); *A63B 2220/803* (2013.01); *A63B 2220/833* (2013.01); *A63B 2220/836* (2013.01); *A63B 2225/02* (2013.01); *A63B 2225/50* (2013.01); *A63B 2225/54* (2013.01); *A63B 2225/68* (2013.01); *A63B 2230/00* (2013.01); *A63B 2230/015* (2013.01); *A63B 2230/062* (2013.01); *A63B 2230/425* (2013.01); *A63B 2230/505* (2013.01); *A63B 2230/605* (2013.01); *A63B 2230/705* (2013.01); *A63B 2230/75* (2013.01); *A63B 2230/755* (2013.01)

(58) Field of Classification Search

CPC ..... A63B 2220/833; A63B 2220/836; A63B 2024/0071; A63B 2024/0068; A63B 2024/0093; A63B 2230/705; A63B 2230/505; A63B 2071/0081; A63B 2071/0625; A63B 2071/0638; A63B 2071/0647; A63B 2071/065; A63B 2225/50; A63B 2225/02; A63B 2225/68; A63B 2225/54; A63B 2022/0278; A63B 69/16; A63B 21/225; A63B 2069/165; A63B 2069/167

USPC ..... 482/1–9, 51, 54

See application file for complete search history.

(56) References Cited

U.S. PATENT DOCUMENTS

| | | | | |
|---|---|---|---|---|
| 6,719,667 | B2 | 4/2004 | Wong et al. | |
| 7,220,219 | B2 | 5/2007 | Papadopoulos | |
| 7,618,353 | B2 | 11/2009 | Papadopoulos | |
| 8,052,580 | B2 * | 11/2011 | Saalasti ..... | A61B 5/024 482/1 |
| 2004/0063549 | A1 * | 4/2004 | Kuo ..... | A63B 22/0242 482/54 |
| 2009/0111656 | A1 | 4/2009 | Sullivan et al. | |
| 2013/0274066 | A1 | 10/2013 | Ashby et al. | |
| 2014/0066264 | A1 | 3/2014 | Haddon et al. | |

FOREIGN PATENT DOCUMENTS

| | | |
|---|---|---|
| TW | 470639 | 1/2014 |
| WO | WO2008150743 | 12/2008 |

OTHER PUBLICATIONS

English Translation via Orbit.com of the Abstract of CN103028228. dated Apr. 10, 2013.

English translation via Orbit.com of the Abstract of TWM470639. dated Jan. 21, 2014.

International Search Report Issued in PCT/US2015/041406 dated Oct. 23, 2015.

* cited by examiner

DETERMINING WORK PERFORMED ON A TREADMILL

CROSS REFERENCE TO RELATED APPLICATIONS

This application claims priority to U.S. Patent Application Ser. No. 62/029,371 filed on 25 Jul. 2014 and titled Determining Work Performed on a Treadmill. U.S. Patent Application Ser. No. 62/029,371 is herein incorporated by reference for all that it discloses.

BACKGROUND

Runners competing in triathlons face difficulty in preparing for racing because of a lack of effective training options for the cycling portions of a race when outdoor cycling is unavailable or undesirable. Various exercise bicycles simulate natural or outdoor cycling with varying degrees of success, but since a triathlete competes on his own bicycle and not the exercise equipment, stationary bike training is less effective in developing the muscle groups, balance, posture, and other elements that can impact the competitor's efficiency and comfort while riding his own bicycle.

Various systems have been devised to allow cyclists to ride on an endless tread belt, but all have come with significant limitations. One such system is disclosed in U.S. Pat. No. 7,220,219 to Papadopoulos. In this reference, a treadmill assembly includes a frame and a treadmill belt. In addition, a sensor produces a signal representative of an aspect of the user's position relative to at least one point on the frame. A belt rotation assembly turns the belt with a speed related to the signal. In one preferred embodiment the speed of the belt is inversely proportional to the distance between the user and the front of the treadmill. In another preferred embodiment the treadmill is sized to support a cycle. Other systems are disclosed in U.S. Pat. No. 7,618,353 to Papadopoulos; U.S. Pat. No. 4,925,183 to Charles F. Lind, and U.S. Pat. No. 5,743,835 to Edward E. Trotter. Each of these references are herein incorporated by reference for all that they contain.

SUMMARY

In one embodiment of the invention, a treadmill system includes a deck, an endless tread belt covering at least a portion of the deck, a motion transducer positioned to detect movement of the tread belt, a processor, and memory. The memory includes instructions executable by the processor to receive an output of the motion transducer, determine an exercise type performed on the tread belt, and calculate an amount of work performed by a user on the tread belt based on the output of the motion transducer and the determined exercise type.

The exercise type may be selected from a group set comprising running, walking, and cycling.

The instructions may be further executable by the processor to calculate the amount of work based, at least in part, on measurements from a physiological sensor associated with the user.

The instructions may be further executable by the processor to determine the exercise type based on user input.

The treadmill system may further include a console connected to a treadmill frame, the console arranged to receive the user input.

The instructions may be further executable by the processor to determine the exercise type based on a signal from exercise equipment positioned on the tread belt.

The exercise equipment may be a bicycle, a user garment, a user shoe, or combinations thereof.

The treadmill system may further include a side rail positioned alongside the deck, the side rail comprising a control feature accessible by the user when riding a bicycle on the tread belt.

The instructions may be further executable by the processor to calculate the amount of work based, at least in part, on an incline angle of the deck.

The instructions may be further executable by the processor to control a motor arranged to drive the tread belt based on, at least in part, on the exercise type.

In one embodiment of the invention, a method of determining work performed by a user on a treadmill includes determining an exercise type performed by the user from the group consisting of a foot exercise or a cycling exercise, calculating the distance traveled by the user, and calculating the work performed by the user based on the distance traveled and the exercise type.

Determining whether the user is performing foot exercise or cycling exercise may include receiving an output from a motion transducer.

Determining an exercise type performed by the user may include determining a vertical position of the user.

Determining an exercise type performed by the user may include analyzing a reading of a load cell incorporated into the deck of the treadmill.

The method may include determining that the exercise type is a foot exercise when the load cell records a periodic load fluctuation measured above a predetermined threshold.

The method may include determining that the exercise type is a cycling exercise when the load cell records a continuous load.

In one embodiment of the present invention, a treadmill system may include a deck, an endless tread belt covering at least a portion of the deck, a motion transducer positioned to detect movement of the tread belt, a position sensor positioned to determine a position of a user relative to the deck, a processor, and memory. The memory includes instructions executable by the processor to receive an output of the motion transducer, determine an exercise type performed on the tread belt base of the user, calculate an amount of work performed by the user based on the output of the motion transducer, and control a parameter of the treadmill system based on the position of the user.

The exercise type may be selected from a group set comprising a foot exercise or a cycling exercise.

The instructions may be further executable by the processor to calculate the amount of work based, at least in part, on measurements from a physiological sensor associated with the user.

The instructions may be further executable by the processor to calculate the amount of work based, at least in part, on an incline angle of the deck.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

As used herein, a "property" of a wireless signal may include a physical property of the signal such as, for example, a signal strength or the directions in which the signal is propagated, and may include a coded property, such as a value modulated into the physical makeup of the signal itself.

As used herein, a "transceiver" is broadly defined to include signal emitters, signal sensors, and emitter/sensors. A transceiver may include an actively detectable device (e.g., an active Wi-Fi antenna) or a passively detectable device (e.g., a radio frequency identification (RFID) tag).

As used herein, a "displacement" of an object may refer to a linear displacement, an angular displacement, or a displacement of another object that is related to the object, such as the angular displacement of a reel on which a cord is wrapped, since the displacement of the reel is related to the linear displacement of an end of the cord.

The present description provides examples, and is not limiting of the scope, applicability, or configuration set forth in the claims. Thus, it will be understood that changes may be made in the function and arrangement of elements discussed without departing from the spirit and scope of the disclosure, and various embodiments may omit, substitute, or add other procedures or components as appropriate. For instance, the methods described may be performed in an order different from that described, and various steps may be added, omitted, or combined. Also, features described with respect to certain embodiments may be combined in other embodiments.

Figure 1:
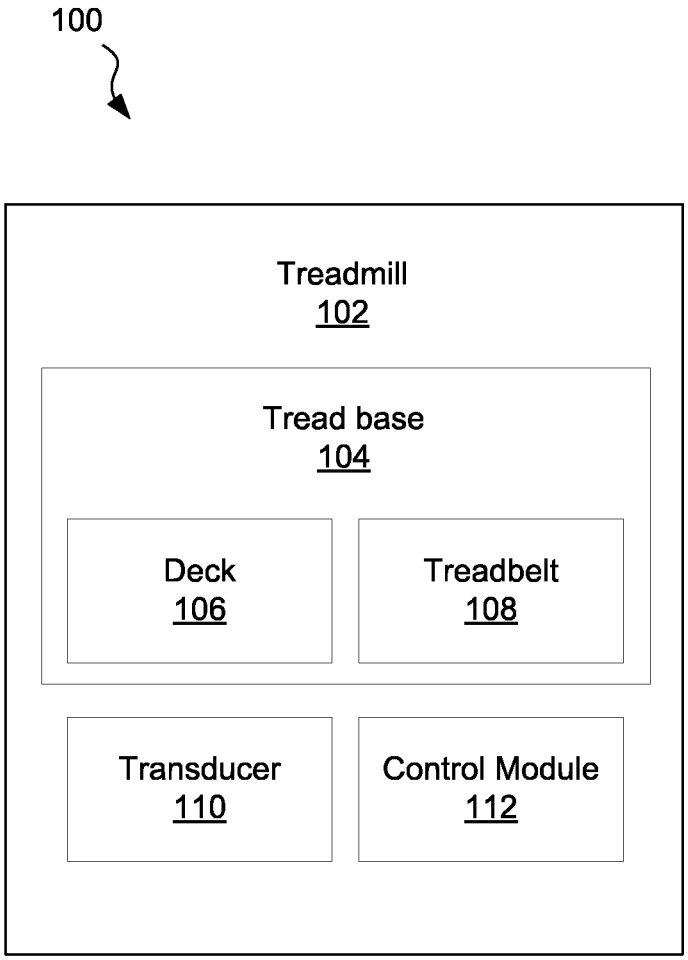
FIG. 1 is a block diagram of an example of a treadmill system in accordance with the present disclosure.

Turning now particularly to the figures, FIG. 1 is a block diagram of a treadmill system 100 having a treadmill 102 having a tread base 104, a transducer 110, and a control module 112. In some embodiments, the treadmill 102 may also have additional components. The treadmill 102 may allow a user to exercise on the tread base 104. The tread base 104 may have a deck 106 and a tread belt 108.

The deck 106 may be a base for the treadmill 102, stabilizing the treadmill 102 and tread belt 108. The tread belt 108 may have a supportive surface below the tread belt 108, and in some cases may include a base support structure for the entire treadmill 102. In some embodiments, the treadmill includes a frame that support a console and other components that the treadmill 102. The deck 106 may incline or decline the exercise surface (e.g., the tread belt 108) for the user. The deck 106 may have a heat conductive material, such as, for example, aluminum and other heat conducting metals, composites, ceramics, and polymers. Typical treadmill decks and tread belts, such as those coated in phenolic resin, may not be able to withstand the heat applied by a loaded bicycle and tread belt 108 at cycling speeds, so a heat conductive material may prevent melting or other complications from rising temperatures on the tread belt 108.

The tread belt 108 may be an endless tread belt driven with one or more rollers, flywheels, and/or motors. Preferably, the tread belt 108 may have an upper surface that moves backward while a user exercises on the treadmill 104. Thus, a user may perform foot exercise on the tread base 104 by ambulating on the tread belt 108. The tread base 104 may also be sized to receive a bicycle on the tread belt 108. Thus, the user may perform cycling exercises by riding a bicycle on the tread belt 108. The tread base 104 may be enlarged compared to a typical tread base of a treadmill that engages solely in foot exercise. The tread belt 108 may also be stiffer than a typical treadmill to accommodate the stresses introduced from cycling. In some embodiments the tread base 104 may have a tread belt 108 about 96 inches long and about 48 inches wide. Other dimensions may be used, as is apparent to those skilled in the art, which dimensions may achieve a balance between space needed for comfortable cycling and limiting the size and cost of the treadmill 102.

The treadmill 102 may have a transducer 110. The transducer 110 may be a position sensor or motion transducer that detects and/or measure motion of the tread belt 108. For example, the transducer 110 may have an encoder or another type of sensor for tracking the distance that a point on the tread belt 108 travels over time. The transducer 110 may also or alternatively determine the velocity of the motion of the tread belt 108. In some embodiments, the transducer 110 measures an output of a motor or movement of a flywheel driving the tread belt 108, such as by measuring the angular displacement or velocity of a motor, roller, flywheel, or other component of the treadmill 102. Thus, movement of the tread belt 108 may be transduced with the transducer sensing the motion of tread belt 108 itself or other components that have movement and positional properties related to the motion of the tread belt 108.

In embodiments where the transducer 110 functions as a position sensor, the transducer 110 may transduce an aspect of the position of the user, a bicycle, or other component in contact therewith in relation to the tread base 104. For example, the transducer 110 may sense the position or velocity of the user relative to the tread base 104 using a wireless rangefinder, such as an infrared emitter that emits infrared emissions toward the user and an infrared sensor that senses reflections of the emissions. The transducer 110 may also sense a signal coming from the user or the bicycle, as in a signal coming from a transmitter such as, for example, a smartphone, a Bluetooth® transmitter device, or other wireless communications-enabled electronic transmitter. A passive device capable of wireless detection, such as a radio-frequency identification (RFID) tag, near-field communications (NFC) tag, or other passively-detectable device may also be detected with the transducer 110 to establish the relative position of the user or bicycle.

Figure 5:
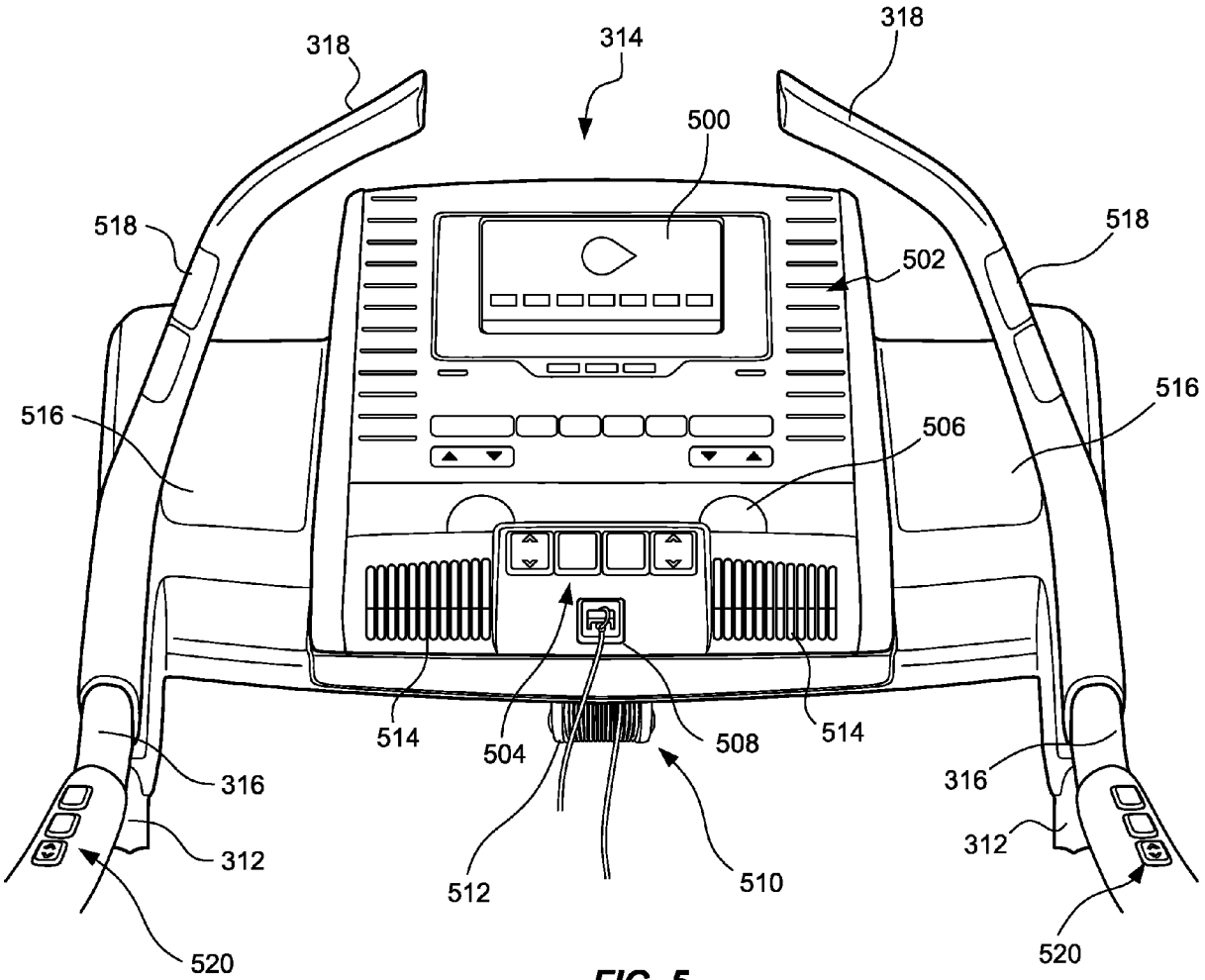
FIG. 5 is a side view of an example of a console in accordance with the present disclosure.

In another example, the transducer 110 may sense the position of the user by sensing the position of a device attached to the user or bicycle. The device may be a tether attached to the user's clothes, equipment, or person, or attached to a portion of the bicycle. The transducer 110 may sense tension of the tether to determine the relative position of the user with respect to the tread base 104. The device may be a tether on a reel (as shown in FIG. 5), in which case the transducer 110 may detect the displacement of the reeled tether (e.g., linear displacement of the tether or angular displacement of the reel) or tension of the tether as tether is pulled from the reel and/or reeled onto the reel, which detected measurements may correspond with the position of the user or bicycle relative to the tread base 104.

The transducer 110 may provide an output to a control module 112. The control module 112 programmed to determine the type of exercise performed by the user. The exercise type may be determined with a single factor or multiple factors. Such factors may include the speed of the tread belt 108, the position of the user, the vertical position of the user, output from a sensor on a bicycle, output from a sensor incorporated into a garment and/or shoe of the user, output from a sensor carried by the user, another type of output, a user input received at the console, another type of mechanism, or combinations thereof. In some examples, the console may be constructed so that the user can switch between a foot exercise mode and a cycling mode.

In some examples, the transducer 110 may output to the processor the types of motions that the transducer detects or other types of information that it detects. Based in part or in full on such an output, the type of exercise may be determined. For example, the output of the transducer 110 may be compared to a predetermined value, and the relationship of the transducer output to the predetermined value may determine the type of exercise performed on the tread base 104. In one example, if the output of the transducer 110 is the velocity of the tread belt 108, the exercise performed may be detected or determined based on whether the velocity is above a predetermined threshold level that indicates cycling is taking place instead of a foot exercise. If the output of the transducer 110 includes a weight measurement, the control module 112 may differentiate between foot exercise and cycling based on the weight of a bicycle being sensed in addition to the weight of the user.

The control module 112 may include a computer, a computing module, or another control logic apparatus capable of receiving the output of the transducer 110, determining the type of exercise performed, and converting the information into work performed by the user for the particular type of exercise being performed. The control module 112 may be connected to a mechanism for displaying the amount of work performed to the user, such as a display (e.g., liquid crystal display (LCD)) on a console of the treadmill 102. In some embodiments, the control module 112 may display the work performed in various measures, such as, for example, in joules (J), kilocalories (kcal), Calories (Cal), Newton-meters (N·m), foot-pounds, other types of measurements, or combinations thereof.

As a result, the treadmill system 100 may provide improved tracking of work performed by tracking work performed in a foot exercise and in a cycling exercise. In some cases, the user does not have to affirmatively act to cause the treadmill system 100 to recognize and adjust to each type of exercise being performed. In some embodiments, the treadmill system 100 may provide a tread base 104 that intelligently adjusts the speed of a tread belt 108 based primarily on the position of the user and the type of exercise being performed. This allows the high speeds of cycling to better simulate road-like conditions than existing solutions, such as, for example by providing a flatter riding surface on the tread belt 108 than training rollers would provide. The treadmill 102 may also dynamically and automatically increase and decrease speed of the tread belt 108 to keep the cyclist on the treadmill 102. Thus, the cyclist is in control of the level of resistance he or she experiences on the treadmill 102, and it may be easier to stay properly positioned when the cyclist starts and stops cycling. In some examples, no rigid connection is made to the rider or the bicycle. So, the cyclist may use his own equipment (e.g., bicycle). Further, the user may naturally change positions on the bicycle or change position relative to the left and right sides of the tread belt 108 while running or riding, as he or she would in common outdoor roadway conditions. When the cyclist transitions from cycling exercises to foot exercises, the system 100 may quickly readjust from providing cycling-specific features to providing foot exercise features. Such a transition may be executed by pressing of a button or with an automated recognition that the type of exercise has been changed. In all, these embodiments may improve the user experience and quality of his workout and may reduce the exercise equipment needed for multiple types of workouts, especially in the case of triathlon competitions.

Figure 2:
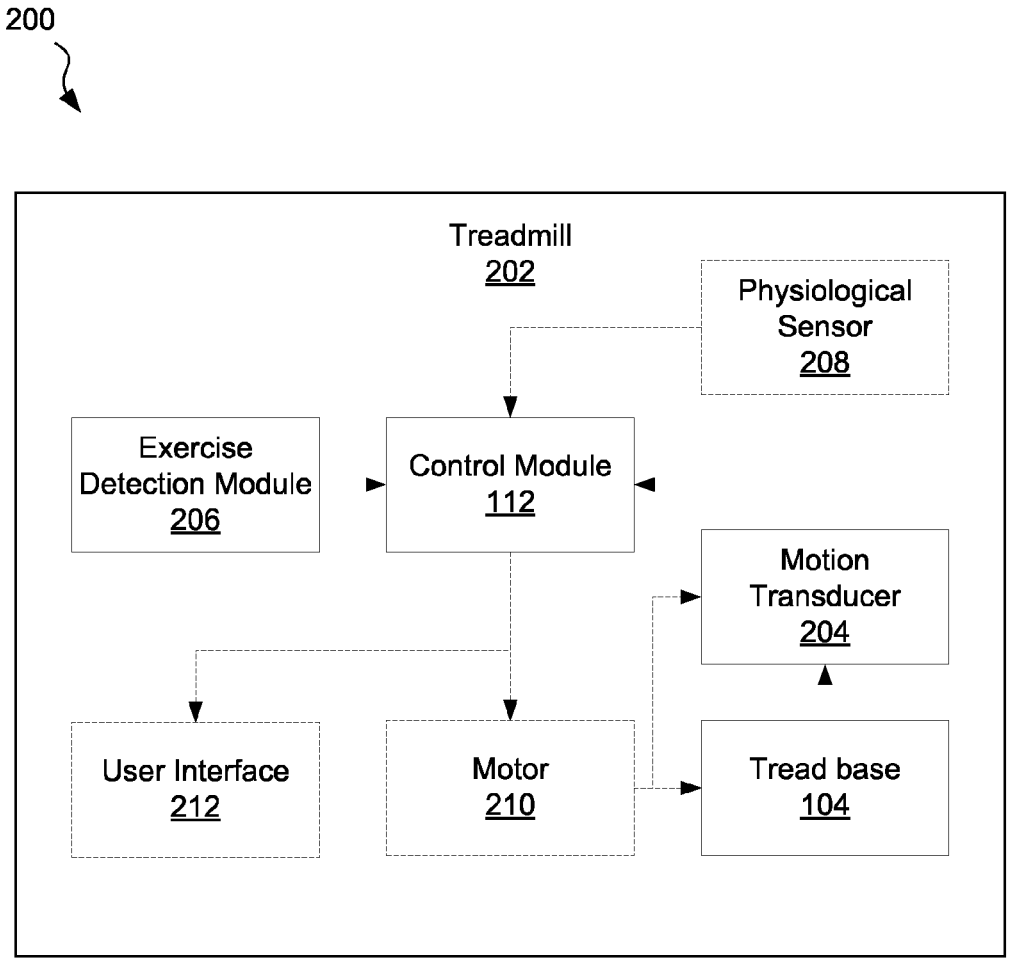
FIG. 2 is a block diagram of an example of a treadmill in accordance with the present disclosure.

FIG. 2 illustrates another example of a treadmill system 200 of the present disclosure. The system 200 includes a treadmill 202 having a tread base 104. The tread base 104 may be the same tread base 104 as described and shown in connection with FIG. 1, such as including a deck 106 and tread belt 108. The motion of the tread base 104 may be measured with a motion transducer 204 that feeds its output to a control module 112. An exercise detection module 206 may also send output to the control module 112. In some embodiments, a physiological sensor 208 may also send output to the control module 112. In some embodiments, the control module 112 may provide control and instructions to a motor 210 that drives one or more elements of the tread base 104 (e.g., the tread belt 108), and in some embodiments the motor output is measured with the motion transducer 204. In some arrangements, the control module 112 may also output control and instructions to a user interface 212.

The motion transducer 204 may transduce the movement of elements of the tread base 104 or motor 210. For example, the motion transducer 204 may detect linear displacement of the tread base 104 or angular displacement of the motor 210. The motion transducer 204 may detect velocity of the tread base 104 or motor 210 as well. In some embodiments, the motion transducer 204 may monitor the motor 210 and tread base 104 simultaneously to improve accuracy by comparison of these elements to each other. The motion transducer 204 may be a linear or angular encoder or other digital or analog mechanism for detecting motion of the motor 210 or tread base 104. In some embodiments, the motion transducer 204 may detect motion of the user or a bicycle on the tread base 104, such as movement forward or backward relative to a deck 106. The motion transducer 204 may be connected to the control module 112 directly or through an interface element, such as, for example, a digital/analog converter (DAC).

The exercise detection module 206 may include a switch or sensor that determines the type of exercise being performed by the user on the treadmill 202. For example, the exercise detection module 206 may be a switch or other user-interactive element on a user interface (e.g., user interface 212) that allows the user to select a foot exercise or a cycling exercise on the treadmill 202. This element may be an electronic or physical switch, such as a button, but may also have other sensor elements such as a portion of a touch screen accessible by the user. The user may manipulate or touch the switch or other element to select a foot exercise mode, a cycling mode, or another type of mode.

In arrangements where the exercise detection module 206 is a sensor, the module 206 may detect a user setting based on user actions or the position of the user. For example, the exercise detection module 206 may have a coil that senses a magnet attached to the treadmill 202 that the user places on the treadmill 202 when either a foot exercise or a cycling exercise is being performed, and the sensing of the magnet indicates that the user has selected one of those settings. Similarly, the exercise detection module 206 may detect that a bike tether or other positioning element is being used that is only used in one exercise type or only used in a certain way in one exercise type, and thereby detect the type of exercise being performed on the treadmill 202 by inference. For example, if the treadmill 202 includes a retractable tether, the exercise detection module 206 may detect that the tether is in use based on a reel holding the tether being unwound by a certain amount and based on the determination of the tether being used, may detect that cycling is being performed (in cases where the tether is only used for cycling). In another example, the exercise detection module 206 may determine the manner in which certain elements are being used, such as by detecting that a tether is being pulled upward or downward relative to the reel, and thereby determine the exercise performed. In such cases, if the tether is pulled upward, the detection module 206 may indicate that the user is cycling instead of exercising on foot, since the user is often higher up while on a bicycle. Settings such as the detection height may be adjustable or customizable to prevent or limit detecting false positives.

Other sensors may be used to detect other elements indicative of the type of exercise being performed. For example, an inductive coil may be positioned on the treadmill 202 to detect metallic objects on the tread base 104 such as a bicycle and thereby detect whether cycling is being performed on the treadmill 202. In some arrangements, the bicycle or other cycling-related equipment (e.g., helmet, gloves, water bottle, clip-in cleats, etc.) may be equipped with a feature configured to be detected with the exercise detection module 206 upon being positioned on the treadmill 202. For example, the feature may be a radio frequency identification (RFID) tag, near-field communications (NFC) device, or other passively-detectable element attached to the cycling-related equipment or bicycle. The exercise detection module 206 may thus be an RFID, NFC, or other reader that detects the presence of the bicycle or other equipment and directs that information to the control module 112 to make appropriate settings for cycling. In the event that such elements are not detected near or in the operative position on the treadmill 202, the control module 112 may adjust speed settings and other controls for foot exercise. Items that are used for a specific type of exercise (e.g., a bicycle) may be referred to as exercise-specific equipment.

In another embodiment, the exercise detection module 206 may have a sensor that detects an active wireless transceiver on the user or bicycle to determine the type of exercise being performed. For example, the user may have a wireless transceiver on his person that emits a wireless signal detectable with the exercise detection module 206. The wireless signal itself (or the absence thereof) may indicate the type of exercise being performed. In some arrangements, the wireless transceiver may be a smartphone or other small electronic device on or around the treadmill 202 that can emit the desired wireless signal.

The exercise detection module 206 may have a load cell or vibration sensor that determines whether foot exercise or cycling exercise is being performed on the treadmill 202 based on the weight sensed or the nature of the impact of the exercise while the treadmill is being operated. For example, a load cell detecting discrete load signals (or another periodic pattern) may indicate that the user is running on the tread belt 108 (due to the discrete or periodic impact of each foot hitting the tread belt 108) as compared to cycling, which may produce a relatively continuous load on the load cell due to the continuous contact of the bicycle wheels with the tread belt 108. In some examples, the load cell determines that a step occurs during a foot exercise when the load changes over a predetermined threshold that represents an impact between a foot and the deck. In some cases, small load changes, such as those under the predetermined threshold, may not indicate a step, but rather a user shifting weight during a cycling exercise. In other situations, the location of the load on the deck may be a factor for determining the type of exercise. For example, if two positions are load on a deck that resemble that of bicycle tires, the system may determine that a cycling exercise is occurring. Similarly, of if the load imparted into the deck occurs in an alternating pattern that reflects the movement of a user running, the system may determine that a foot exercise is occurring.

The physiological sensor 208 may have a sensor that measures physical characteristics of the user while he or she is using the treadmill 202. The physiological sensor 208 may therefore include a heart rate monitor or temperature sensor having output directed to the control module 112. The control module 112 may then use this information to improve the calculation of work performed by the user on the treadmill 202. For example, if the physiological sensor 208 is a heart rate monitor (e.g., an ECG), the heart rate of the user may be factored into the intensity of his workout, whether on foot or on a bicycle, and this indicator of his exertion may be used to calculate whether additional calories are being consumed in the exercise. The output of the control module 112 may then more accurately reflect the user's workout. In some embodiments, the physiological sensor 208 may be attached to the user, but in other embodiments, the physiological sensor 208 may be attached to the treadmill 202. For example, heart rate monitoring electrodes may be incorporated into the handles of the bicycle and or hand holds of the treadmill 202. In other embodiments the bicycle handles may be modified to take heart rate measurements. The use of heart rate-monitoring treadmill handles or bicycle handles may be an indicator used in an exercise detection module 206 to determine the type of exercise being performed on the treadmill 202. In some embodiments, the physiological sensor 208 may be a weight measurement device for detecting the weight of the user. A body fat analyzer may also be incorporated as part of the physiological sensor 208. By factoring the weight and/or body fat of the user into the calculation of work performed, the calculation may take into account the amount of effort required by the user to travel a certain distance and accordingly adjust the estimated work performed. In some embodiments, no physiological sensor 208 is included in the treadmill system.

The motor 210 may be an electrical motor that drives the motion of the exercise surface (e.g., the tread belt 208) of the tread base 104. The motor 210 may be controlled with the control module 112 according to the type of exercise being performed, such as, for example, by increasing the velocity of the exercise surface when cycling is being performed. In some arrangements, the motor 210 may be controlled to increase or decrease speed in response to measurements regarding the position of the user as well, as described in more detail below in connection with FIG. 8. The output of the motor 210 may be part of a feedback loop with the motion transducer 204 to monitor the speed and motion of the elements of the tread base 104 being driven with the motor 210. In some embodiments, a motor 210 may not be used, such as when the tread base 104 is driven by the motion of the user or bicycle or when the tread base 104 includes a flywheel.

A user interface 212 may be linked to the control module 112. The user interface 212 may have a display, control features, buttons, conditional indicators (e.g., LEDs or buzzers), and other interactive or display features. The user interface 212 may therefore exchange information between the user and the control module 112. In some embodiments, the user interface 212 may have a console extending from the tread base 104. The console may include the display, switches, and other elements of the user interface 212. The exercise detection module 206 may receive information from the user interface 212 regarding the exercise selected by the user, or the exercise detection module 206 may be included as part of the user interface 212 for that reason. For example, a user may select the type of exercise to be performed with the treadmill 202 by manipulating a switch, button, or other element found in the user interface 212. Elements of the user interface 212 may be positioned on the console, and some elements may be positioned on side rails of the treadmill 202, as described below in connection with FIGS. 3 and 5.

Figure 3:
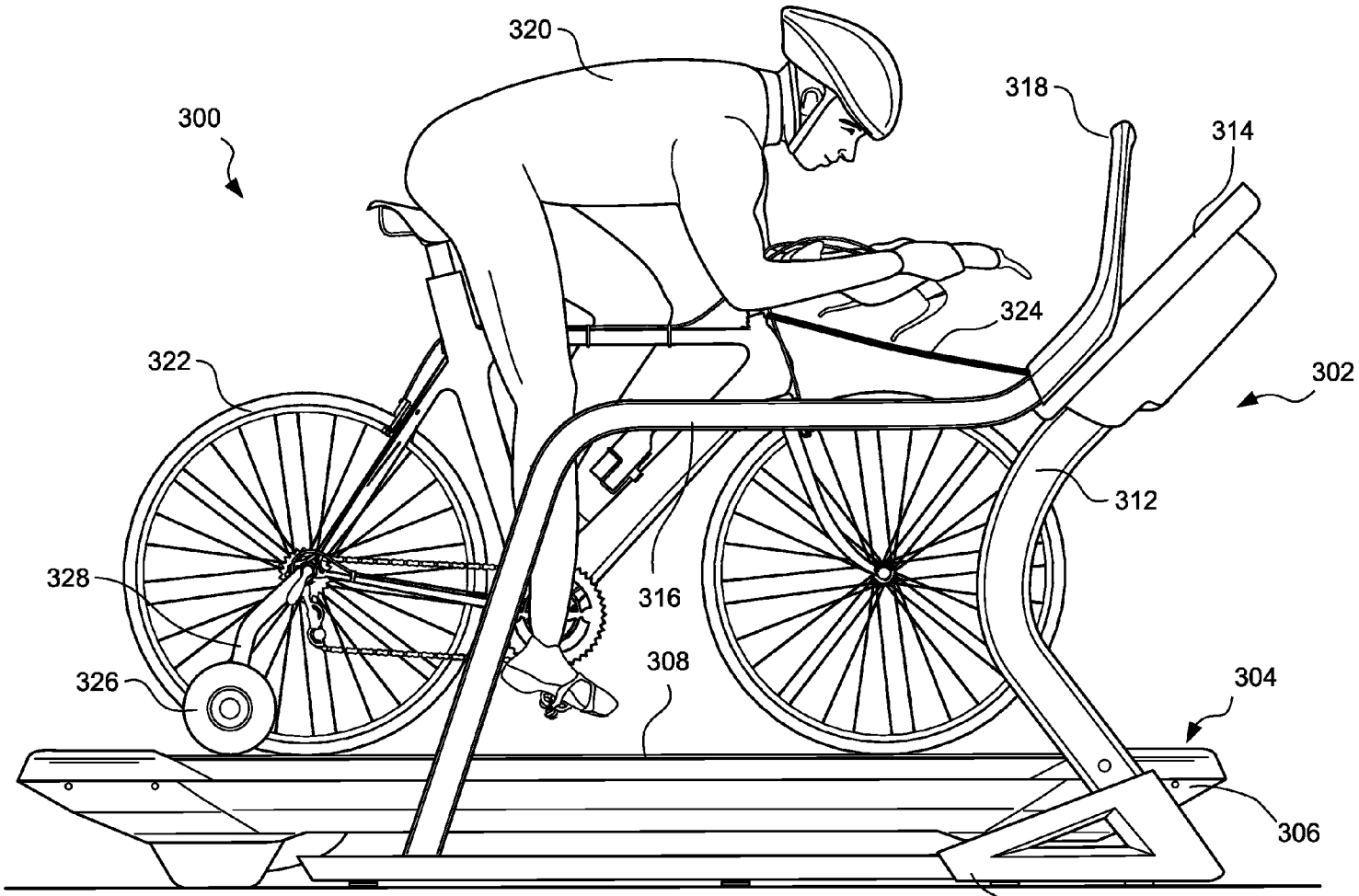
FIG. 3 is a side view of an example of a treadmill system in accordance with the present disclosure.

FIG. 3 is an illustration of a treadmill system 300 according to an embodiment of the present disclosure. The treadmill 302 may include a tread base 304 that may have a deck 306 and a tread belt 308. The tread base 304 may also include a support frame 310 that may rest on a support surface (e.g., a floor). The frame 310 may have one or more upright supports 312 connected to a console 314, side rails 316, and upright handles 318. A cyclist 320 may be positioned on a bicycle 322 riding on the tread belt 308. The bicycle 322 may be connected to the treadmill 302 through a tether 324. The bicycle 322 may also have one or more additional wheels 326 extending from at least one of its wheels into contact with the tread base 304. These additional wheels may contact the tread base 304 at all times, or may be raised from the tread base 304 to only contact the tread base 304 when the bicycle tilts to a certain angle. Thus, the additional wheels 326 may be configured similar to traditional training wheels, where one wheel is positioned extending to each side of the bicycle 322 from an extension bar 328. Using the additional wheels 326 may improve the stability of the bicycle 322 for the cyclist while the tether 324 is in use. The additional wheels 326 may be designed to have low friction when in contact with the tread belt 308 to damage prevent heat induced damage to the tread belt 308 while in use.

The tether 324 may removably attach to the bicycle 322 or to the user 320. The tether 324 may be part of a motion or position sensing system or as part of an exercise detection module, such as by connection with a transducer 110, motion transducer 204, and/or exercise detection module 206. In such cases, the tension or displacement (e.g., linear displacement of the tether or angular displacement of a tether retraction reel) of the tether 324 and related portions of the treadmill 302 may be used to determine the position of the user 320 or bicycle 322. The position of the user 320 or bicycle 322 may then be used to control the speed of the tread belt 308, or to determine the type of exercise performed. The tread base 304 may include a motor (not shown) to drive the tread belt 308 and may be capable of inclination and declination. The motor, or another motor (e.g., motor 402 of FIG. 4), may be used to incline and decline the deck 306 and tread belt 308. Thus, the deck 306 and tread belt 308 may be used for cycling or foot exercise in an inclined or declined angle.

Figure 4:
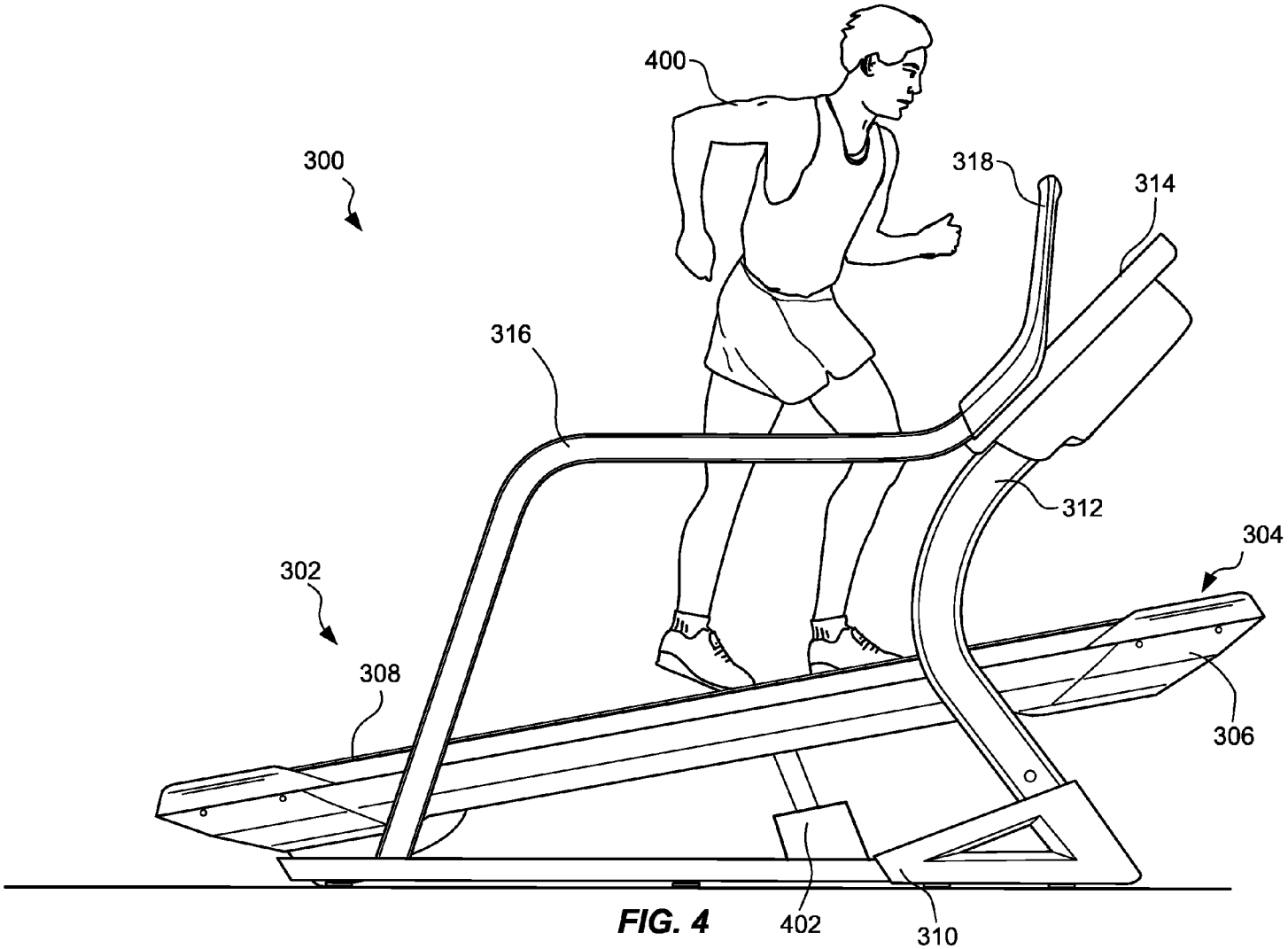
FIG. 4 is a side view of an example of a treadmill system in accordance with the present disclosure.

FIG. 4 shows an illustration of the treadmill system 300 where the deck 306 and tread belt 308 are inclined, and a running user 400 is engaging in foot exercise on the inclined surface. This view also shows the motor 402 used to incline or decline the tread base 304. The tread base 304 in these example embodiments is pivotable at the rear end of the deck 306, but in other embodiments the deck 306 may pivot at a midpoint or front end.

The side rails 316 of the treadmill 302 may extend along the length of the tread base 304. The side rails 316 may also include controls for the speed, incline, and other features (e.g., controls of a preprogrammed routine or controls of an onboard video/audio system) of the treadmill 302. By placing at least some of the controls on the side rails 316, the controls may be accessible while cycling. Other controls (e.g., on the console 314) may be unduly difficult to reach and control while cycling since the cyclist 320 is behind handlebars and a front wheel of the bicycle 322. Extended side rails 316 may also provide an additional point of stability for a cyclist mounting a bicycle on the tread belt 308 and help keep the bicycle in position on the tread belt 308.

FIG. 5 is an illustration of a console 314 according to an embodiment of a combined foot exercise and cycling treadmill. The console 314 may be console 314 described in connection with FIGS. 3 and 4. The console 314 may be supported with upright supports 312 and side rails 316. The console 314 may be positioned nearby upright handles 318. The console 314 may include a screen 500, interactive buttons 502, 504, speakers 506, a safety clip 508, a tether attachment point 510 (which may include a tether attachment reel 512), air vents 514, and storage spaces 516. The upright handles 318 may have sensors 518 such as heart rate or body fat sensors to collect data about the user while he or she exercises. Side rail controls 520 may conveniently allow control of at least some settings of the treadmill while the user is cycling and the other buttons 502, 504 may be difficult to reach.

The buttons 502, 504 may be used to control the speed, incline, video, audio, vents' 514 output, and other settings of the treadmill. In some embodiments, the buttons 502, 504 may include a feature for specifying the type of exercise being performed on the treadmill, such as, for example, an exercise type toggle button or selection switch.

The safety clip 508 may be attached to a tether extending from the console 314 to attach to the user or his bicycle while riding the treadmill. This tether may act as a safety mechanism in that when the tether is pulled far enough from the clip 508, the clip 508 may be removed and cause the treadmill to immediately or gradually stop motion of the exercise surface (e.g., the tread belt).

A positioning tether may extend from the attachment point 510 to the user or bicycle. The positioning tether may be used in positioning the user or bicycle relative to the treadmill, such as in positioning the user or bicycle relative to the console 314. The positioning tether attached to the attachment point 510 may hang from the console 314, and the tension in the positioning tether may be measured to detect the position of the user based on the weight of the positioning tether and the distance between the attachment point 510 and the user or bicycle. In these embodiments, the positioning tether may have a constant length that does not extend or retract from the console. Some arrangements may have a positioning tether having elastic properties, wherein the length of the positioning tether may not be constant, but the tension in the positioning tether between the user or cycle and the console 314 may increase or decrease in response to movement of the user or bicycle relative to the console 314. In another embodiment, the positioning tether may be wound around a tether attachment reel 512 that unwinds and rewinds the positioning tether as the user or bicycle moves toward or away from the console 314. Thus, angular displacement of the reel 512 or linear displacement of the positioning tether may correlate with the position of the user or bicycle. A motion or position transducer at the attachment point 510 may read the displacement of the tether or reel 512 and send that information to a control module to determine the exercise performed or to control the speed of the tread base.

Figure 6:
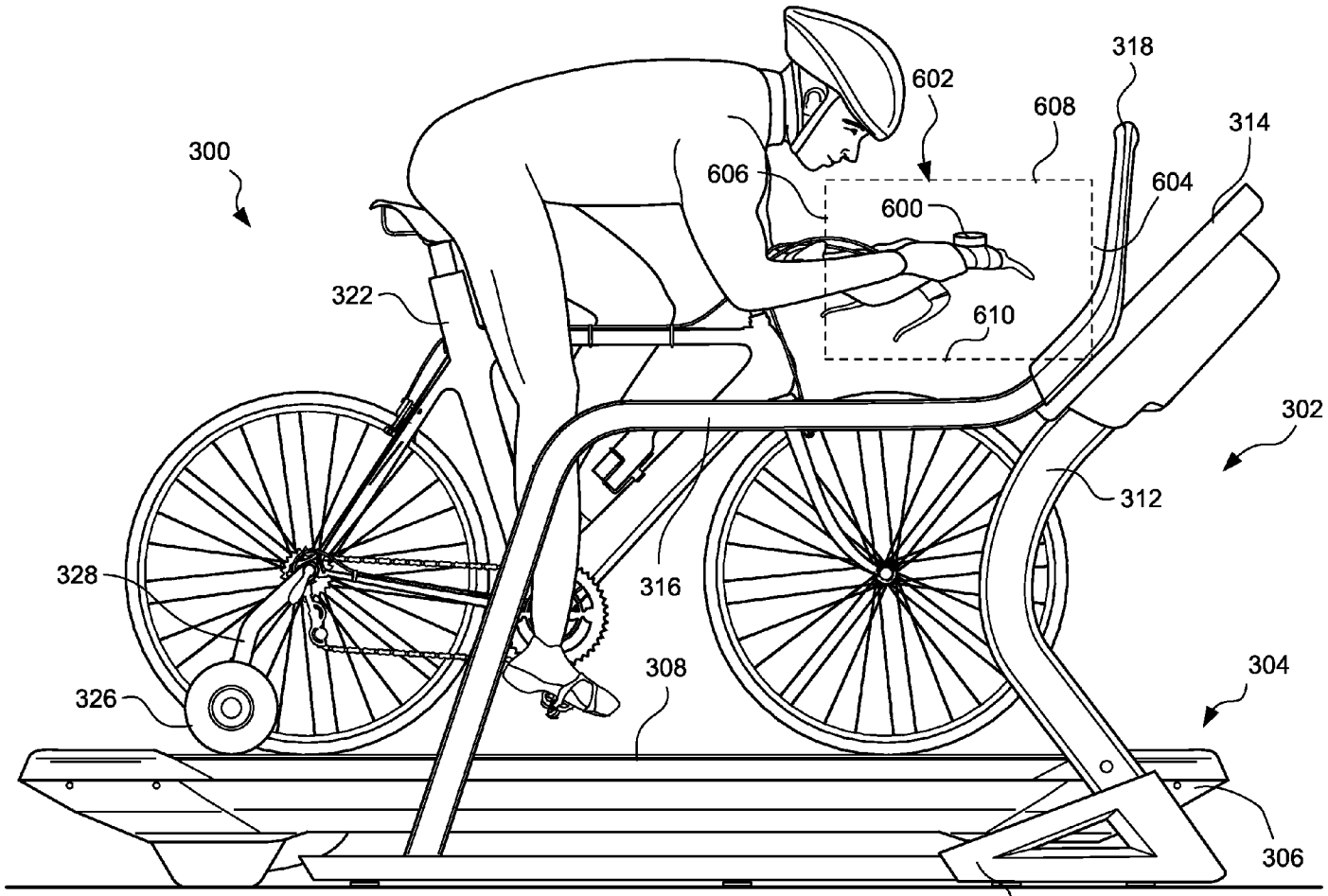
FIG. 6 is a side view of an example of a treadmill system in accordance with the present disclosure.

FIG. 6 is an illustration of a treadmill system 300 wherein a position transceiver 600 may be used to control settings of the treadmill 302. The position transceiver 600 may be attached to the bicycle or to the user. The position transceiver 600 may be an actively or passively detectable device, such as a signal emitter or RFID tag, as described in greater detail in connection with the preceding figures.

The position transceiver 600 may be used as a reference point to determine the position of the user or the bicycle. For example, the position transceiver 600 may be attached to the user or the bicycle at a predetermined location, such as on a belt loop, collar, front handlebar, front fork, or other portion of the user or bicycle. Thus, a nominal position of the position transceiver 600 relative to the tread belt 308 may be established. In the illustrated embodiment, the position transceiver 600 is attached to a handlebar of the bicycle 322. The center of bounding box 602 may be an exemplary nominal position for the position transceiver 600. As the runner or cyclist exercises on the tread base 304, the position of the position transceiver 600 may be monitored. If the position transceiver 600 moves forward toward the front end 604 of the bounding box 602, the speed of the tread belt 308 may be increased. Similarly, movement of the position transceiver backward toward the rear end 606 of the bounding box 602 may result in the speed of the tread belt 308 being decreased. These and other methods of controlling the tread belt 308 are further set forth in FIG. 8. By controlling the speed of the tread belt 308, the position transceiver 600 may be automatically repositioned to stay in and around the nominal position within the bounding box 602 based on the natural acceleration and deceleration of the operator. Thus, accelerating on foot or on a bicycle causes the tread belt 308 to accelerate and the position transceiver 600 (and connected user or bicycle) is kept from falling off the front of the tread base 304 or colliding with the upright supports 312 or console 314.

In some embodiments, there may be no position transceiver 600 attached to the user or bicycle. In such instances, the position transceiver 600 may be replaced with a sensed position of a runner, cyclist, or bicycle through other means, such as through sensing the position using a tether (e.g., tether 324) or another positioning system (e.g., infrared- or laser-rangefinding). In these embodiments, the movement of the sensed position within the bounding box 602 may affect the speed of the tread belt 308, as described in connection with the position transceiver 600. For example, the tread belt 308 may accelerate as the rangefinder senses the position of a bicycle approaching the front end 604 of the bounding box 602.

The bounding box 602 may have adjustable dimensions. Some arrangements may have a bounding box 602 that is larger for running than for cycling, for example. This may be advantageous since the high speeds of cycling compared to running would allow for less margin of error in speed adjustments to keep the cyclist in a predetermined nominal position when compared to running. Thus, when switching between settings for cycling or foot exercise, the bounding box 602 size parameters may be adjusted. The amount of speed adjustment relative to motion within the bounding box 602 may also vary based on the type of exercise being performed. For example, the tread belt 308 may accelerate/decelerate more per inch of movement within the bounding box 602 for cycling than for foot exercise.

In some embodiments, the position transceiver 600 may be detected within a vertical dimension of the bounding box 602, such as relative to the top edge 608 and the bottom edge 610. This vertical position may be used to determine the type of exercise being performed, such as a higher register corresponding with cycling versus a lower register for running, or vice versa. Individual implementations may thus vary the vertical size of the bounding box 602 to fit the needs of each user.

Figure 7A:
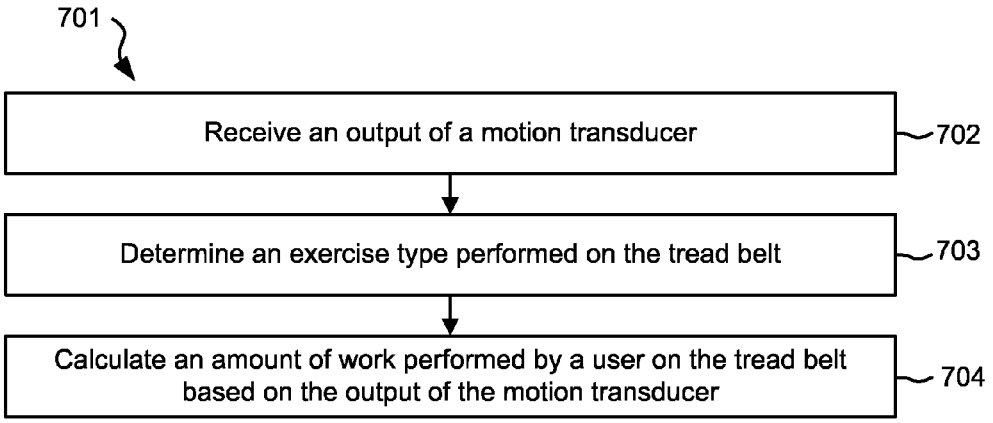
FIG. 7A is a flowchart of an example of a method for determining work performed by a user on a treadmill in accordance with the present disclosure.

FIG. 7A is a flowchart of an example of a method for determining work performed by a user on a treadmill in accordance with the present disclosure. The process 701 may be performed with a control module (e.g., control module 112 of FIGS. 1 and 2). At block 702, an output is received from a motion transducer. Such an output may indicate the motion of the user, the motion of the tread belt, the speed of the tread belt, other parameters, or combinations thereof.

At block 703, the type of exercise performed on the tread belt is determined. This determination may be made, at least in part, from the output of the motion transducer. In one particular example, the motion transducer determines the speed of the tread belt. If the speed of the tread belt if high enough, the type of exercise may be determined to be a cycling exercise. On the other hand, if the speed is below typical cycling speeds, the type of exercise may be determined to be a foot exercise. But, the exercise type determination may be based on information other than the output from the motion transducer. For example, a position sensor may provide information that indicates that the user is at a vertical position typical when the user is riding a bicycle. In other examples, the exercise type is determined based on user input. In some cases, multiple factors may be considered to determine the type of exercise. Additionally, a learning mechanism may be used to analyze the success rate of accurately determining the exercise type. In situations where the exercise type was incorrectly determined, such a learning mechanism may reminder the conditions to correctly determine the exercise type in future situations.

At block 704, an amount of work performed by the user on the tread belt is calculated based on the output of the motion transducer. Cycling exercises may allow a user to travel a greater distance with less exertion as compared to foot exercises. Thus, the system may apply different equations for determining the work performed, or the system may perform a scaling process to calculate the work performed based on the exercise type.

Figure 7B:
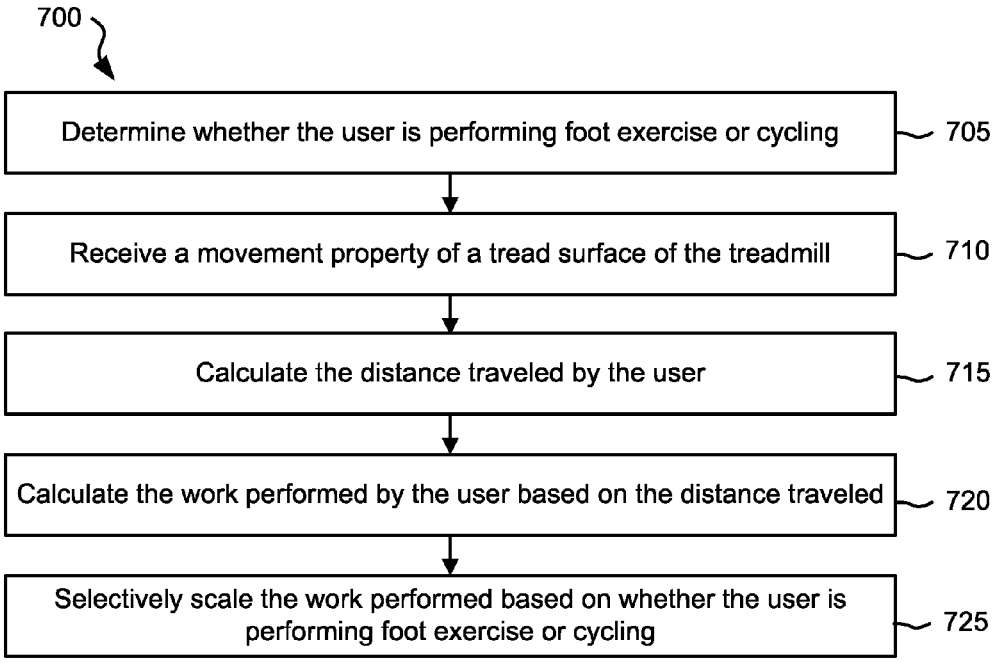
FIG. 7B is a flowchart of an example of a method for determining work performed by a user on a treadmill in accordance with the present disclosure.

FIG. 7B is a flowchart of an example of a method for determining work performed by a user on a treadmill in accordance with the present disclosure. The process 700 may be performed with a control module (e.g., control module 112 of FIGS. 1 and 2). At block 705, a determination is made of whether the user is performing foot exercise or cycling on the treadmill. This may be performed using the exercise detection module 206, bounding box 602, or other related exercise detection elements discussed previously herein. For example, determining whether the user is performing foot exercise or cycling may include determining the position of the user relative to the treadmill or detecting a wireless signal coming from the user or a device on the user or the bicycle (e.g., a position transceiver 600).

At block 710, a movement property of a tread surface of the treadmill is received. The tread surface may be a tread belt (e.g., tread belt 108) or other moving surface of the treadmill on which exercise is performed. The movement property may be output with a transducer, such as transducer 110 or motion transducer 204. The movement property may be the displacement of the tread surface, the rate of displacement of the tread surface, or a displacement of a component connected thereto, such as a motor output shaft (e.g., on motor 210) or a flywheel. The movement property (e.g., distance traveled) may be stored with the control module.

At block 715, the control module may calculate the distance traveled by the user. This may entail reading stored data including the movement property received in block 710 to determine the overall distance traveled over a certain period of time (or over all-time). In some arrangements, the movement property itself may be a cumulative property, so there may be no calculation of the distance traveled, or the calculation may be simply converting a "count" (e.g., from an encoder) or other cumulative measurement into a distance usable in blocks 720 and/or 725.

At block 720, the work performed by the user is calculated based on the distance traveled. This calculation may include determining the energy output by the user (or an average user) over the distance traveled, as calculated in block 715 (or as provided in block 710). For example, for an average user, the energy output needed to travel one kilometer may be a known quantity, so in block 720, the work performed may be proportional to that known quantity. In other embodiments, the calculation may include determining an energy output per unit distance for a user having the weight, size, sex, and other characteristics of the user on the treadmill, as will be understood by those having skill in the art and having the benefit of the present disclosure. In performing block 720, the control module may use the determination reached in block 705 of the exercise being performed to determine the work performed. For example, since cycling is typically less work-intensive than foot exercise per unit distance, the calculation of block 720 may use a different known quantity for each type of exercise.

In some embodiments, block 725 may also be performed, where the work performed may be scaled according to the type of exercise being performed, such as, for example, by applying a scaling factor that converts work performed over a given distance by cycling into work performed by foot exercise, or vice versa. The work performed may be calculated based on the incline or decline of the deck, since incline and decline may affect the exertion needed to move along the tread belt through a unit distance. Thus, the incline or decline of the deck may be part of a scaling factor or determination of effective distance traveled. Physiological sensor output (e.g., from physiological sensor 208) may also be integrated into the work performed, as discussed in greater detail above.

Following calculation of work performed (e.g., blocks 720 and/or 725) the control module may output the work performed. This may include indicating the work performed on a display (e.g., screen 500) or presenting the amount of work performed to the user through another type of mechanism. This may also include sending a work performed value to a computer or network location (e.g., the Internet). By determining the type of exercise being performed in the process 700, the user may better track his work performed no matter the kind of exercise he or she is performing on the treadmill.

Figure 8:
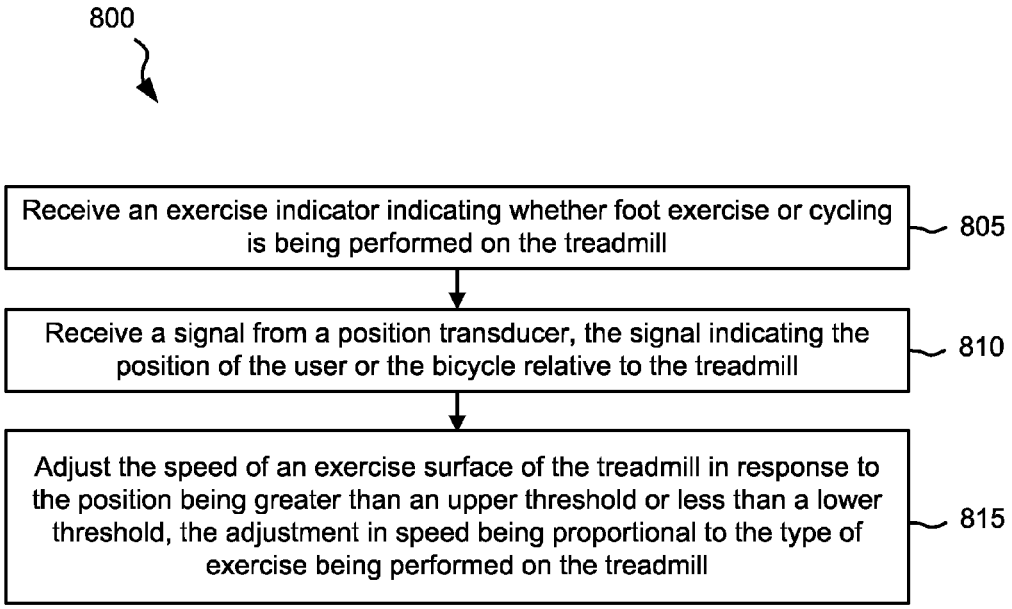
FIG. 8 is a flowchart of an example of a method for determining work performed by a user on a treadmill in accordance with the present disclosure.

FIG. 8 is a flowchart of an example of a method for determining work performed by a user on a treadmill in accordance with the present disclosure. The process 800 may be implemented with a control module (e.g., control module 112) of a treadmill (e.g., treadmill 102, 202). In block 805, the control module receives an exercise indicator indicating whether foot exercise or cycling is being performed on the treadmill. This exercise indicator may come from an exercise detection module 206, motion transducer 204, position transceiver 600, or other sensor associated with the treadmill that is capable of differentiating between foot exercise and cycling. For example, the exercise indicator may be based on a user input (e.g., from a button pressed or other manual selection operation).

In block 810, the control module receives a signal from a position transducer. The signal indicates the position of the user or the bicycle relative to the treadmill. For example, the position transducer may indicate the position of the user or bicycle relative to a tread belt of the treadmill (e.g., tread belt 308). The position transducer may have position detectors and transducers discussed in connection with other figures, such as, for example, a tether 324, transducer 110, motion transducer 204, exercise detection module 206, other like components, and combinations thereof. The position transducer may indicate whether foot exercise or cycling is being performed on the treadmill, as discussed in connection with the position transceiver 600 and other elements above. For example, the exercise indication may indicate a vertical position of the user or the bicycle, and that vertical position may be indicative of the type of exercise being performed. A wireless signal may be received as part of block 810, and the wireless signal may have a property indicating the position of the user or the bicycle relative to the treadmill.

In block 815, the controller adjusts the speed of an exercise surface of the treadmill (e.g., the tread belt 108, 308) in response to the position being greater than an upper threshold (e.g., the position transceiver 600 being closer to the front end 604 than the nominal position) or less than a lower threshold (e.g., the position transceiver 600 being closer to the rear end 606 than the nominal position). In some embodiments, the upper threshold and lower threshold may, respectively, be the front end 604 and rear end 606, or vice versa. The adjustment of speed may be proportional to the type of exercise being performed on the treadmill, as determined or received in block 805. Thus, the control module may accelerate a tread belt faster when the exercise indicator indicates cycling and the position approaches the upper limit than when the exercise indicator indicates foot exercise and the position approaches the upper limit. In some arrangements, the upper and lower thresholds may be different for each type of exercise as well. In some embodiments, adjusting the speed in block 815 may include stopping a tread belt of the treadmill when the position of the user or the bicycle is greater than the upper threshold or less than the lower threshold.

In other arrangements, the upper and lower thresholds are only used for one type of exercise and ignored in the other. This may be used in situations where runners desire to train at a specified rate and do not want the treadmill to adapt to their fatigue or spurts of exertion. On the other hand, cycling is often performed at higher treadmill speeds, and the user may more easily stay within the confines of the tread belt surface when accelerating, braking, or coasting. Furthermore, an adaptive speed control for cycling may better simulate actual roadway conditions.

Figure 9:
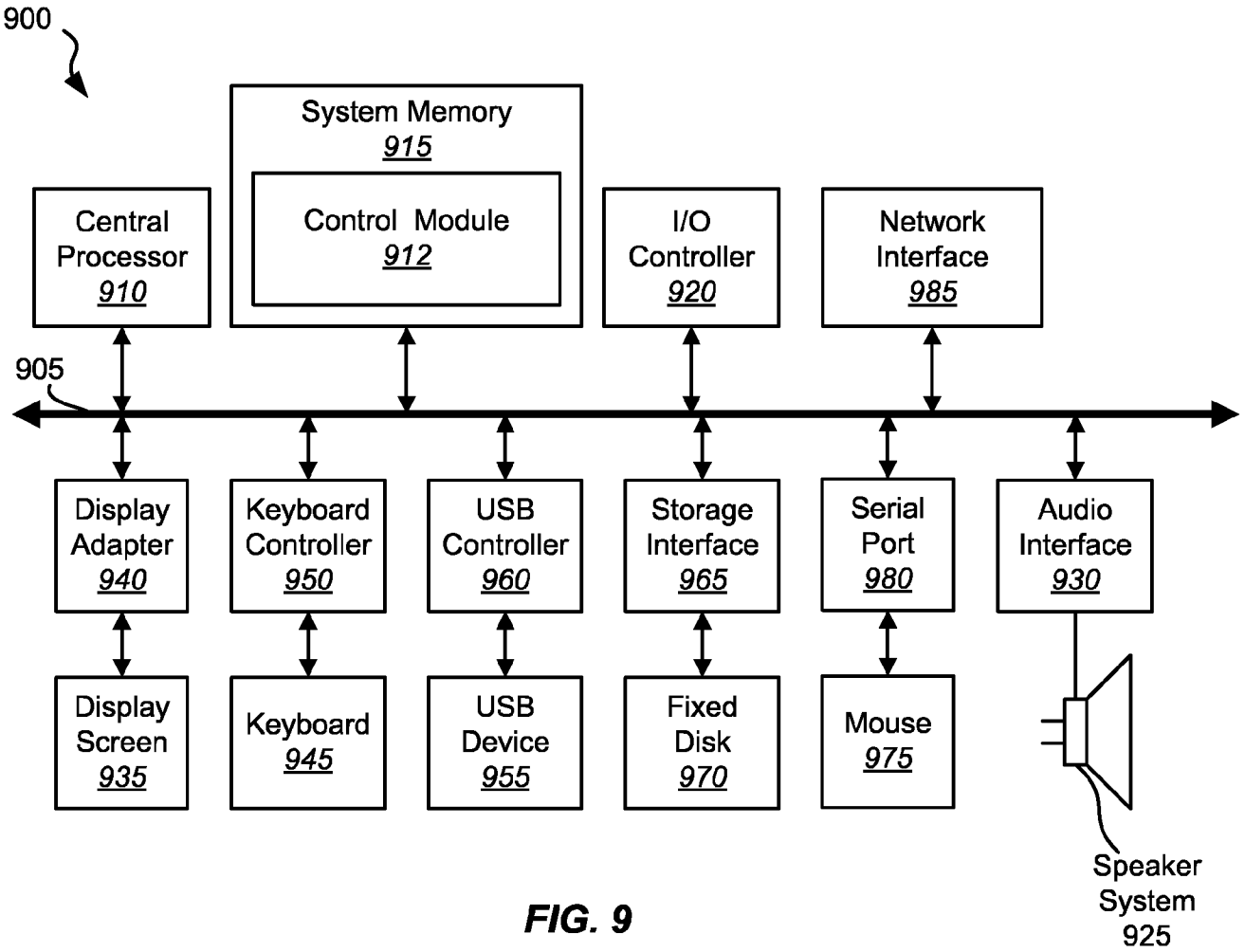
FIG. 9 depicts a block diagram of an example of a computer system suitable for implementing various embodiments of the present disclosure.

FIG. 9 depicts a block diagram of a computer system 900 suitable for implementing some embodiments of the present systems and methods. For example, the computer system 900 may be suitable for implementing the control modules described herein as being on the treadmill (e.g., control module 112 of FIG. 1). Computer system 900 includes a bus 905 which interconnects major subsystems of computer system 900, such as a central processor 910, a system memory 915 (typically RAM, but which may also include ROM, flash RAM, or the like), an input/output controller 920, an external audio device, such as a speaker system 925 through an audio output interface 930, an external device, such as a display screen 935 (e.g., screen 500 of FIG. 5) through a display adapter 940, a keyboard 945 (interfaces with a keyboard controller 950) (or other input device, e.g., buttons 502, 504 of FIG. 5), multiple universal serial bus (USB) devices 955 (interfaces with a USB controller 960), and a storage interface 965. Also included are a mouse 975 (or other point-and-click device) interfaced through a serial port 980 and a network interface 985 (coupled directly to bus 905). In some embodiments, only some or portions of these elements are present and connected to the bus 905.

Bus 905 allows data communication between central processor 910 and system memory 915, which may include read-only memory (ROM) or flash memory (neither shown), and random access memory (RAM) (not shown), as previously noted. The RAM is generally the main memory into which the operating system and application programs are loaded. The ROM or flash memory can contain, among other code, the Basic Input-Output system (BIOS) which controls basic hardware operation such as the interaction with peripheral components or devices. For example, a control module 912 to implement the present systems and methods may be stored within the system memory 915. The control module 912 may be one example of the control module 112 described in connection with FIG. 1 and part of various computing modules or controllers discussed herein. Applications resident with computer system 900 are generally stored on and accessed with a non-transitory computer readable medium, such as a hard disk drive (e.g., fixed disk 970) or other storage medium. Additionally, applications can be in the form of electronic signals modulated in accordance with the application and data communication technology when accessed through interface 985.

Storage interface 965, as with the other storage interfaces of computer system 900, can connect to a standard computer readable medium for storage and/or retrieval of information, such as a fixed disk drive 970. Fixed disk drive 970 may be a part of computer system 900 or may be separate and accessed through other interface systems. Network interface 985 may provide a direct connection to a remote server (e.g., the server described above) through a direct network link to the Internet through a POP (point of presence). Network interface 985 may provide such connection using wireless techniques, including digital cellular telephone connection, Cellular Digital Packet Data (CDPD) connection, digital satellite data connection, or the like.

Many other devices or subsystems (not shown) may be connected in a similar manner (e.g., document scanners, digital cameras, and so on). Conversely, all of the devices shown in FIG. 9 need not be present to practice the present systems and methods. The devices and subsystems can be interconnected in different ways from that shown in FIG. 9. The operation of a computer system such as that shown in FIG. 9 is readily known in the art and is not discussed in detail in this application. Code to implement the present disclosure can be stored in a non-transitory computer-readable medium such as one or more of system memory 915 or fixed disk 970. The operating system provided on computer system 900 may be iOS®, MS-DOS®, MS-WINDOWS®, OS/2®, UNIX®, Linux®, MAC OS X®, or another like operating system.

While the foregoing disclosure sets forth various embodiments using specific block diagrams, flowcharts, and examples, each block diagram component, flowchart step, operation, and/or component described and/or illustrated herein may be implemented, individually and/or collectively, using a wide range of hardware, software, or firmware (or any combination thereof) configurations. In addition, any disclosure of components contained within other components should be considered exemplary in nature since many other architectures can be implemented to achieve the same functionality.

The process parameters and sequence of steps described and/or illustrated herein (e.g., in connection with FIGS. 7-8) are given by way of example only and can be varied as desired. For example, while the steps illustrated and/or described herein may be shown or discussed in a particular order, these steps do not necessarily need to be performed in the order illustrated or discussed. The various exemplary methods described and/or illustrated herein may also omit one or more of the steps described or illustrated herein or include additional steps in addition to those disclosed.

Furthermore, while various embodiments have been described and/or illustrated herein in the context of fully functional computing systems, one or more of these exemplary embodiments may be distributed as a program product in a variety of forms, regardless of the particular type of computer-readable media used to actually carry out the distribution. The embodiments disclosed herein may also be implemented using software modules that perform certain tasks. These software modules may include script, batch, or other executable files that may be stored on a computer-readable storage medium or in a computing system. In some embodiments, these software modules may configure a computing system to perform one or more of the exemplary embodiments disclosed herein.

Figure 10:
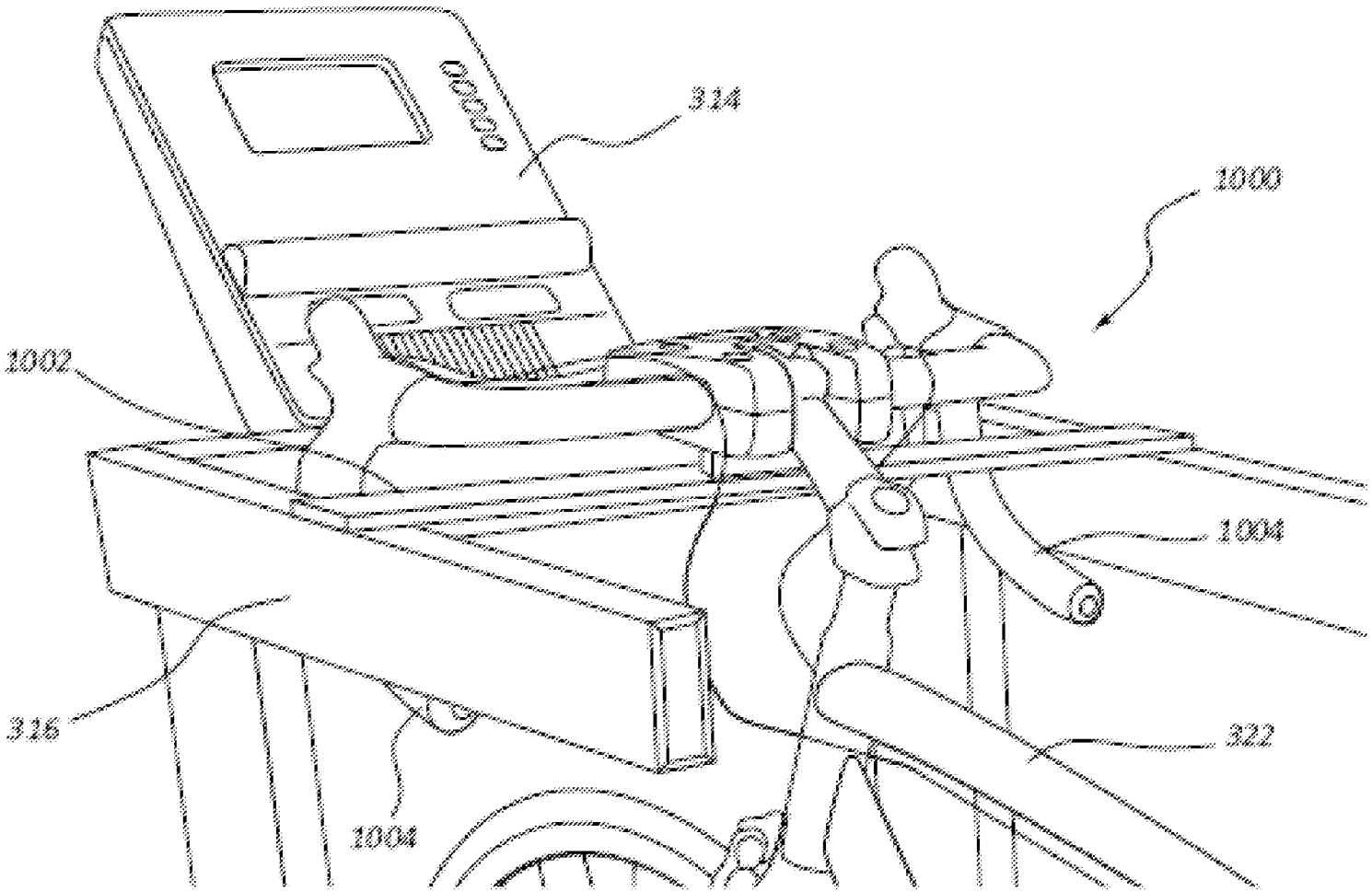
FIG. 10 depicts a perspective view of an example of a bicycle attachment in accordance with the present disclosure.

FIG. 10 depicts a perspective view of an example of a bicycle attachment 1000 in accordance with the present disclosure. In this example, the bicycle attachment 1000 comprises a bar 1002 that spans from one of the side rails 316 to the other. The bar 1002 is positioned to along the length of the side rails 316 to allow the handlebars 1004 of the bicycle 322 pass through a gap formed between the bar 1002 and the console 314 of the treadmill. After the handlebars pass through the gap, the bicycle 322 may be moved rearward such that a portion of the handlebars is against the bar 1002.

In some examples where both the front wheel and the rear wheel of the bicycle are in contact with the tread belt and the bicycle attachment of FIG. 10 is used, the bicycle may have the ability to tilt within a limited range because the bicycle connection is not rigid. Further, with such a non-rigid connection, the bicycle may move from side to side within a limited range, as well as move forward and backwards within a limited range.

In some examples, the bar 1002 have a straight shape as depicted in FIG. 10. But, in other examples, the bar 1002 have at least a curved portion, a bent portion, or another type of portion that assists is positioning the bicycle with respect to the treadmill 102. In some examples, the bar 1002 supports at least a portion of a weight of the bicycle through the bicycle attachment 1000. In such an example, the bar 1002 may be positioned such that the front wheel of the bicycle 322 is lifted off of the tread belt. In some examples, having just the rear wheel in contact with the tread belt may reduce the number of forces affecting the bicycle's stability.

Figure 11:
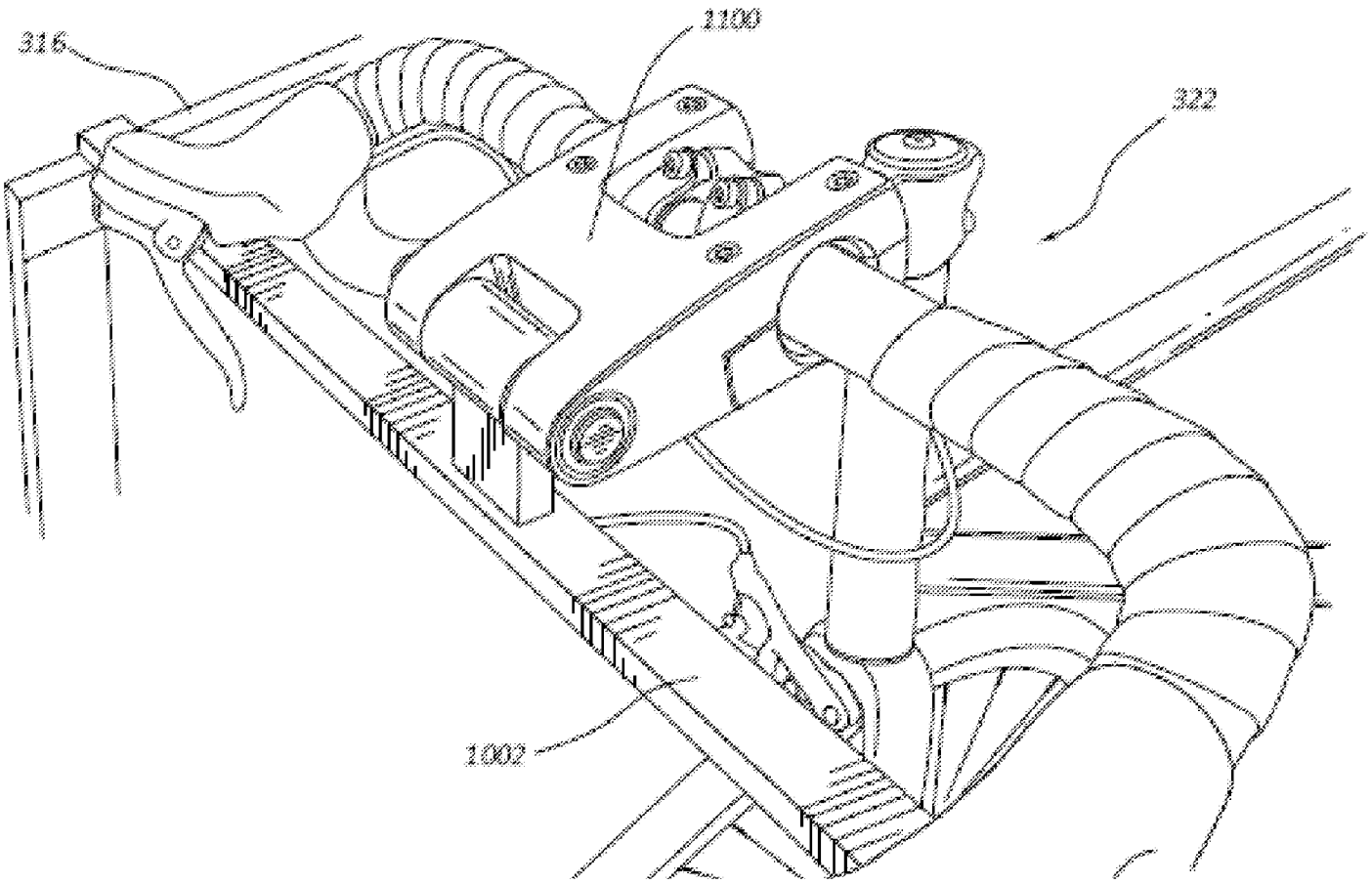
FIG. 11 depicts a perspective view of an example of a bicycle attachment in accordance with the present disclosure.

FIG. 11 depicts a perspective view of another example of a bicycle attachment 1000. In this example, a clamp 1100 is attached to the handlebars of the bicycle 322 at a first end. On a second end of the clamp 1100, the clamp 1100 is connected to a bar 1002 that connects to the treadmill's side rails 316. In this example, the clamp 1100 rigidly attaches the bicycle 322 to the treadmill such that the handlebars of the bicycle cannot move with respect to the treadmill.

While this example has been described with specific reference to a clamp with a specific shape and arrangement, any appropriate type of clamp and/or other type of attachment may be used. For example, two independent clamps may be attached to each of the handlebars to connect the handlebars to the treadmill's side rails. Further, the attachment mechanism may connect the handlebars or a portion of the bicycle's frame to a portion of the treadmill other than the side rails. For example, the attachment mechanism may be attached to the console or a portion of the treadmill proximate the console. Further, the attachment mechanism may include different types of attachment features such as screw clamps, elastomeric material, compression fits, groove and tongue slots, hooks, cables, fasteners, other types of attachment features, or combinations thereof.

The foregoing description, for purpose of explanation, has been described with reference to specific embodiments. But, the illustrative discussions above are not intended to be exhaustive or to limit the invention to the precise forms disclosed. Many modifications and variations are possible in view of the above teachings. The embodiments were chosen and described in order to best explain the principles of the present systems and methods and their practical applications, to thereby enable others skilled in the art to best use the present systems and methods and various embodiments with various modifications as may be suited to the particular use contemplated.

Unless otherwise noted, the terms "a" or "an," as used in the specification and claims, are to be construed as meaning "at least one of." In addition, for ease of use, the words "including" and "having," as used in the specification and claims, are interchangeable with and have the same meaning as the word "comprising." In addition, the term "based on" as used in the specification and the claims is to be construed as meaning "based at least upon." Throughout this disclosure the term "example" or "exemplary" indicates an example or instance and does not imply or require any preference for the noted example. Thus, the disclosure is not to be limited to the examples and designs described herein but is to be accorded the widest scope consistent with the principles and novel features disclosed herein.

THE GENERAL DESCRIPTION OF THE INVENTION

In general, the invention disclosed herein may provide the user with a treadmill that has a natural feel for training across multiple types of exercises, such as foot exercises, cycling exercises, and others. Embodiments of the treadmill systems herein may allow the user to use her own bicycle or other equipment while training indoors and under controlled conditions. Thus, muscle groups, balance, posture, and other elements are more effectively trained. Additionally, embodiments of the treadmill systems may provide the user with an estimate of work performed whether on foot or cycling, allowing her to track progress and increase exercise efficiency interchangeably between each exercise type. Changing between exercise types may allow users to train using foot exercise and cycling exercises on the same piece of equipment, potentially reducing storage space requirements for the user. Further, users training for a triathlon may train for the transition between cycling and running with the treadmill system described above.

In some cases, the system described above may also allow the user to focus on training without determining whether the treadmill system is set to the proper exercise mode because the treadmill system can determine the type of exercise being performed by the user and accordingly adjust the parameters of the treadmill to account for the different exercises changes. For example, when the user performs a foot exercise on the treadmill, the treadmill speeds and other parameters of the treadmill can automatically adjust to for foot exercises. On the other hand, when the user is cycling, the treadmill system can automatically adjust to speeds appropriate for cycling.

Cycling and foot exercises may demand different levels of exertion to move a given distance. Thus, the treadmill system described herein may calculate work performed by the user based on the type of exercise performed. For instance, in some cases the system may track a proportionally higher rate of work performed for foot exercise in comparison to work performed during cycling. Additionally, such systems may identify optimal biometric measurements for each type of exercise, such as by identifying an optimal heart rate or pace for foot exercise that differs from cycling. Differentiation between foot exercise and cycling may also provide a more immersive exercise experience in treadmills having simulated workout scenery videos by allowing the video display to simulate the conditions of the different types of exercise in the video depending on the exercise being performed.

Embodiments of the combined foot exercise and cycling treadmill may determine work performed by the user using a control module that receives output of a motion transducer which tracks movement of the tread belt such as displacement or velocity. Such a control module may include a processor and memory to determine the amount of work performed. Such a control module may determine the amount of work performed based on the weight of the user, the average weight of a typical user, the weight of the bicycle, and other factors, or combinations thereof. The work performed may also be scaled based on the type of exercise performed, the gearing settings of the bicycle being used, and/or biological characteristics the user, or combinations thereof.

The position of the user or bicycle may be determined relative to the treadmill using a position sensor. In some embodiments the position sensor may include a tether attached to the user or bicycle, and the tension or displacement of the tether may be sensed to determine the position of the user on the treadmill. Additionally or alternatively, the position sensor may have a wireless transceiver that receives a signal from the user or bicycle. The signal may have a property indicating the position of the user or bicycle or may be coded with information directly dictating the position of the user. In other examples, the position sensor includes a camera that can determine the vertical position of the user relative to the tread belt. Such a camera may determine whether a bicycle is positioned on the tread belt, whether a user is positioned on the tread belt, whether a user is positioned on the tread belt without a bicycle, other determinations, or combinations thereof.

By determining the position of the user or bicycle on the treadmill, a control module may adjust the speed of the tread belt to reactively simulate exercise on a non-treaded surface. For example, when cycling, the control module may increase the speed of the tread belt when the bicycle's position approaches the front of the treadmill or may decrease the speed of the tread belt when the bicycle drifts backward, thereby keeping the bicycle approximately centered in the treadmill. This allows the cyclist to naturally vary her speed on the treadmill without moving off of the treadmill. Additionally, braking the bicycle may be used to slow the speed of the treadmill and allow an essentially "touch-free" riding experience to the cyclist, where tread belt motion is independent of the user's interaction with control buttons or other input mechanism of the control console. These position-based features may or may not be disabled for foot exercise, as desired by the user. When enabled for foot exercise, the adjustment features and tread belt speed settings may be calibrated to closely follow standard foot exercise speeds and rates of change in speed, which may differ significantly from cycling speeds and rates of change in speed. Thus, one treadmill may quickly and seamlessly provide multiple exercise activities. Triathlon competitors may find this fast-changing capability advantageous in practicing transitions between foot racing and cycling in a controlled environment.

In some embodiments, the position of the user may be determined by receiving a signal from a wireless transmitter on the user or the bicycle. These embodiments may include a transmitter such as, for example, a smartphone, a Bluetooth® transmitter device, or other wireless communications-enabled electronic transmitter. A passive device capable of wireless detection, such as a radio-frequency identification (RFID) tag, near-field communications (NFC) tag, or other passively-detectable device may also be detected with the treadmill to establish positioning.

While the present disclosure has thus far been directed primarily toward the field of triathlon training, it will be understood by those having skill in the art and having the benefit of this disclosure that elements and principles disclosed herein are applicable in other fields and scenarios, including, without limitation, general running and cycling exercise, training for running or cycling events other than triathlons, physical fitness, physical training, rehabilitation, walking, jogging, and the like. Similarly, while this disclosure relates particularly to exercise using bicycles, it will be understood that in addition to bicycles, other human-powered wheeled vehicles may be used or benefit from the present disclosure, such as, for example, tricycles or unicycles. Furthermore, the present disclosure should be construed as extending to all kinds of these wheeled vehicles, whether or not they are designed particularly for racing or for use on roadways.

In some cases, the treadmill may include a tread base that may have a deck and a tread belt. The tread base may also include a support frame that may rest on a support surface. The frame may have one or more upright supports connected to a console, side rails, and upright handles. A cyclist may be positioned on a bicycle riding on the tread belt. The bicycle may be connected to the treadmill with a tether. The bicycle may also include one or more additional wheels extending from at least one of its wheels into contact with the tread base. These additional wheels may contact the tread base at all times, or may be raised from the tread base to only contact the tread base when the bicycle tilts to a certain angle. Thus, the additional wheels may be configured similar to traditional training wheels, where one wheel is positioned extending to each side of the bicycle from an extension bar. Using the additional wheels may improve the stability of the bicycle for the cyclist while the tether is in use. The additional wheels may be designed to have low friction when in contact with the tread belt to damage prevent heat induced damage to the tread belt 308 while in use.

The tether may removably attach to the bicycle or to the user. The tether may be part of a motion or position sensing system or as part of an exercise detection module, such as by connection with a transducer, motion transducer, and/or exercise detection module. In such cases, the tension or displacement of the tether and related portions of the treadmill may be used to determine the position of the user or bicycle. The position of the user or bicycle may then be used to control the speed of the tread belt, or to determine the type of exercise performed. The tread base may include a motor to drive the tread belt and may be capable of inclination and declination. The motor may be used to incline and decline the deck and tread belt. Thus, the deck and tread belt may be used for cycling or foot exercise in an inclined or declined angle.

In some cases, the side rails of the treadmill may extend along the length of the tread base. The side rails may also include controls for the speed, incline, and other features of the treadmill. By placing at least some of the controls on the side rails, the controls may be accessible while cycling. Other controls may be unduly difficult to reach and control while cycling since the cyclist is behind handlebars and a front wheel of the bicycle. Extended side rails 316 may also provide an additional point of stability for a cyclist mounting a bicycle on the tread belt 308 and help keep the bicycle in position on the tread belt.

The console may be supported with upright supports and side rails. The console may be positioned nearby upright handles. The console may include a screen, interactive buttons, speakers, a safety clip, a tether attachment point, air vents, and storage spaces. The upright handles may include sensors such as heart rate or body fat sensors to collect data about the user while he or she exercises. Side rail controls may conveniently allow control of at least some settings of the treadmill while the user is cycling and the other buttons may be difficult to reach.

The buttons may be used to control the speed, incline, video, audio, vents' output, and other settings of the treadmill. In some embodiments, the buttons may include a feature for specifying the type of exercise being performed on the treadmill, such as, for example, an exercise type toggle button or selection switch.

The safety clip may be attached to a tether extending from the console to attach to the user or his bicycle while riding the treadmill. This tether may act as a safety mechanism in that when the tether is pulled far enough from the clip, the clip may be removed and cause the treadmill to immediately or gradually stop motion of the exercise surface.

A positioning tether may extend from the attachment point to the user or bicycle. The positioning tether may be used in positioning the user or bicycle relative to the treadmill, such as in positioning the user or bicycle relative to the console. The positioning tether attached to the attachment point may hang from the console, and the tension in the positioning tether may be measured to detect the position of the user based on the weight of the positioning tether and the distance between the attachment point and the user or bicycle. In these embodiments, the positioning tether may have a constant length that does not extend or retract from the console. Some arrangements may have a positioning tether having elastic properties, wherein the length of the positioning tether may not be constant, but the tension in the positioning tether between the user or cycle and the console may increase or decrease in response to movement of the user or bicycle relative to the console. In another embodiment, the positioning tether may be wound around a tether attachment reel that unwinds and rewinds the positioning tether as the user or bicycle moves toward or away from the console. Thus, angular displacement of the reel or linear displacement of the positioning tether may correlate with the position of the user or bicycle. A motion or position transducer at the attachment point may read the displacement of the tether or reel and send that information to a control module to determine the exercise performed or to control the speed of the tread base.

A position transceiver may be attached to the bicycle or to the user. The position transceiver may be an actively or passively detectable device, such as a signal emitter or RFID tag, as described in greater detail in connection with the preceding figures.

The position transceiver may be used as a reference point to determine the position of the user or the bicycle. For example, the position transceiver may be attached to the user or the bicycle at a predetermined location, such as on a belt loop, collar, front handlebar, front fork, or other portion of the user or bicycle. Thus, a nominal position of the position transceiver relative to the tread belt may be established. In the illustrated embodiment, the position transceiver is attached to a handlebar of the bicycle. The center of bounding box may be an exemplary nominal position for the position transceiver. As the runner or cyclist exercises on the tread base, the position of the position transceiver may be monitored. If the position transceiver moves forward toward the front end of the bounding box, the speed of the tread belt may be increased. Similarly, movement of the position transceiver backward toward the rear end of the bounding box may result in the speed of the tread belt being decreased. By controlling the speed of the tread belt, the position transceiver may be automatically repositioned to stay in and around the nominal position within the bounding box based on the natural acceleration and deceleration of the operator. Thus, accelerating on foot or on a bicycle causes the tread belt to accelerate and the position transceiver (and connected user or bicycle) is kept from falling off the front of the tread base or colliding with the upright supports or console.

In some embodiments, there may be no position transceiver attached to the user or bicycle. In such instances, the position transceiver may be replaced with a sensed position of a runner, cyclist, or bicycle through other means, such as through sensing the position using a tether or another positioning system. In these embodiments, the movement of the sensed position within the bounding box may affect the speed of the tread belt, as described in connection with the position transceiver. For example, the tread belt may accelerate as the rangefinder senses the position of a bicycle approaching the front end of the bounding box.

The bounding box may have adjustable dimensions. Some arrangements may have a bounding box that is larger for running than for cycling, for example. This may be advantageous since the high speeds of cycling compared to running would allow for less margin of error in speed adjustments to keep the cyclist in a predetermined nominal position when compared to running. Thus, when switching between settings for cycling or foot exercise, the bounding box size parameters may be adjusted. The amount of speed adjustment relative to motion within the bounding box may also vary based on the type of exercise being performed. For example, the tread belt may accelerate/decelerate more per inch of movement within the bounding box for cycling than for foot exercise.

In some embodiments, the position transceiver may be detected within a vertical dimension of the bounding box, such as relative to the top edge and the bottom edge. This vertical position may be used to determine the type of exercise being performed, such as a higher register corresponding with cycling versus a lower register for running, or vice versa. Individual implementations may thus vary the vertical size of the bounding box to fit the needs of each user.

What is claimed is:

1. A treadmill system, comprising:

a deck;

an endless tread belt covering at least a portion of the deck;

a position sensor positioned to determine a position of a user relative to the deck;

a processor and memory, wherein the memory includes instructions executable by the processor to:

determine a motion of the tread belt;

determine an exercise type performed on the tread belt by the user, wherein the exercise type is selected from a group set comprising running, walking, and cycling;

control a parameter of the treadmill system based on the position of the user during the motion of the tread belt; and calculate an amount of work performed by a user on the tread belt based on the motion of the tread belt and the determined exercise type.

2. The treadmill system of claim 1, wherein the instructions are further executable by the processor to calculate the amount of work based, at least in part, on measurements from a physiological sensor associated with the user.

3. The treadmill system of claim 1, wherein the instructions are further executable by the processor to determine the exercise type based on user input.

4. The treadmill system of claim 3, further comprising a console connected to a treadmill frame, the console arranged to receive the user input.

5. The treadmill system of claim 1, wherein the instructions are further executable by the processor to determine the exercise type based on a signal from exercise equipment positioned on the tread belt.

6. The treadmill system of claim 5, wherein the exercise equipment is a bicycle, a user garment, a user shoe, or combinations thereof.

7. The treadmill system of claim 1, further comprising a side rail positioned alongside the deck, the side rail comprising a control feature accessible by the user when riding a bicycle on the tread belt.

8. The treadmill system of claim 1, wherein the instructions are further executable by the processor to calculate the amount of work based, at least in part, on an incline angle of the deck.

9. The treadmill system of claim 1, wherein the instructions are further executable by the processor to control a motor arranged to drive the tread belt based on, at least in part, on the exercise type.

10. A treadmill system, comprising:

a deck;

an endless tread belt covering at least a portion of the deck;

a motion transducer positioned to detect movement of the tread belt;

a position sensor positioned to determine a position of a user relative to the deck;

a processor and memory, wherein the memory includes instructions executable by the processor to:

receive an output of the motion transducer;

determine an exercise type performed on the tread belt by the user;

calculate an amount of work performed by the user based on the output of the motion transducer; and control a parameter of the treadmill system based on the position of the user.

11. The treadmill system of claim 10, wherein the exercise type is selected from a group set comprising a foot exercise or a cycling exercise.

12. The treadmill system of claim 10, wherein the instructions are further executable by the processor to calculate the amount of work based, at least in part, on measurements from a physiological sensor associated with the user.

13. The treadmill system of claim 6, wherein the instructions are further executable by the processor to calculate the amount of work based, at least in part, on an incline angle of the deck.

* * * * *